US005346426A

United States Patent [19]

Kronfält

[11] Patent Number: 5,346,426

[45] Date of Patent: Sep. 13, 1994

[54] METHOD AND AN APPARATUS IN VENTILATION

[76] Inventor: Mats Kronfält, S-262 42 Ängelholm, Nordanvindsgatan 7 C, Sweden

[21] Appl. No.: 927,494

[22] PCT Filed: Apr. 2, 1991

[86] PCT No.: PCT/SE91/00248

§ 371 Date: Sep. 29, 1992

§ 102(e) Date: Sep. 29, 1992

[87] PCT Pub. No.: WO91/14905

PCT Pub. Date: Oct. 3, 1991

[30] Foreign Application Priority Data

Mar. 29, 1990 [SE] Sweden ..... 9001142

[51] Int. Cl.[5] ..... F24F 13/068

[52] U.S. Cl. ..... 454/66; 454/239; 454/252; 454/258; 454/284; 454/306; 454/322

[58] Field of Search ..... 454/49, 66, 188, 190, 454/192, 239, 251, 258, 284, 290, 252, 306, 322

[56] References Cited

U.S. PATENT DOCUMENTS

| | | | |
|---|---|---|---|
| 690,252 | 12/1901 | Ennis | 454/251 |
| 2,438,606 | 3/1948 | Hulton | 454/66 |
| 3,368,474 | 2/1968 | Sklar | 454/66 |
| 3,537,381 | 11/1970 | Austin | 454/66 |
| 4,598,631 | 7/1986 | Everett | 454/251 X |
| 4,805,521 | 2/1989 | Eckebring et al. | 454/284 |
| 5,033,362 | 7/1991 | Huckestein | 454/66 X |
| 5,167,577 | 12/1992 | Kristensson | 454/66 X |

FOREIGN PATENT DOCUMENTS

| | | | |
|---|---|---|---|
| 2600478 | 7/1977 | Fed. Rep. of Germany | 454/192 |
| 207738 | 12/1982 | Japan | 454/251 |
| 268940 | 11/1987 | Japan | 454/66 |
| 89/11929 | 12/1989 | PCT Int'l Appl. | 454/66 |

*Primary Examiner*—Harold Joyce
*Attorney, Agent, or Firm*—Ladas & Parry

[57] ABSTRACT

A method and apparatus for the mechanical ventilation and heating of a premises with improved removal of impurities from air present in the premises. At least one suction extraction device is provided for removing polluted or stale air in a region adjacent to the ceiling of the premises. Pure supply air at a temperature in the region of or exceeding the air temperature of the premises is supplied to the premises in the lower region thereof. The supply air forms a substantially horizontal and vertically narrow air jet for displacement of existing air located in a region proximate the floor. The apparatus (1) includes one low impulse device (10) and one high impulse device (20), in addition to which at least one device (31) is provided for guiding air (supply air) emitted from a fan system to the high impulse device and/or to the low impulse device. The device is operative to guide the air from the fan system to the high impulse device when the temperature of the supply air is in the region of or exceeds the temperature in the premises.

18 Claims, 4 Drawing Sheets

METHOD AND AN APPARATUS IN VENTILATION

FIELD OF THE INVENTION

The present invention relates to a method and an apparatus for ventilating and heating a premises.

BACKGROUND AND PRIOR ART

In the mechanical ventilation of a premises, the air is supplied to the premises by means of high impulse devices or by means of low impulse devices. The term high impulse device is taken to signify impulse devices which emit air to the ventilated area at high speed, while the term low impulse device is taken to signify devices which emit air at low speed. High impulse devices are employed in mixing ventilation, while low impulse devices are employed in displacing ventilation.

In mixing ventilation, a sufficient quantity of outdoor air is admixed so that the indoor air will be sufficiently pure. In this instance, a dilution of the indoor air will be obtained, and a uniform distribution of air pollutants present in the room.

In displacing ventilation, the air supplied by the low impulse device (the supply air) flows out over substantially all accessible parts of the floor of the room and forms an air stratum, as a rule at a height of the order of between 0.1 and 0.3 m. The height of the stratum is principally determined by the temperature of the supply air in relation to the air temperature in the room, and by the flow rate when the supply air leaves the impulse device. The supply air is at a lower temperature than the air which is present in the room. The flow rate of the supply air out of the low impulse device is kept relatively low and is, as a rule, of the order of between 0.3 and 0.8 m/s. From the region adjacent to the floor, the air rises towards the ceiling of the room and is evacuated from the room by suction extractors located in or adjacent to the ceiling. On movement towards the ceiling, the air entrains air pollutants which are present in the room and also absorbs thermal energy. Thereby, the air in the room is purified of pollutants at the same time as the air temperature is kept at the desired level.

Low impulse devices are unsuitable for use for heating purposes, since, in order to realize heating, the supply air must be at a higher temperature than the existing indoor air. The higher temperature and the consequential low density of the supply air, in combination with the low aspiration speed, entail that the air, once it has left the device, relatively rapidly assumes a substantially vertical direction of flow. As a result, substantially only air pollutants or impurities in a region adjacent to the device will be conveyed off, while, outside this region, the temperature and level of pollutants in the indoor air are affected to but an insignificant degree. The wish, in situations in which low impulse devices are employed and heating needs arise, to be able to switch to heating of the ventilated room by means of warm supply air while at the same time maintaining a low concentration of impurities at the occupied zone (the level most proximal the floor) has hitherto defied ready solution. This despite the fact that displacing ventilation has been employed for the last 15–20 years, and, with time, been put to greater and greater use, in particular in industrial premises.

SUMMARY OF THE INVENTION

The present invention proposes a method and an apparatus in which the above-indicated desiderata are satisfied. This is attained by means of a method and an apparatus according to the invention in which a first impulse device supplies air uniformly and at low speed from the floor to a height of 2 to 2.5 meters thereabove during cooling and ventilation phases of said space, and a second impulse device supplies a narrow air jet, above the air from the first impulse device, at a high flow rate during heating and ventilation phases of said space.

BRIEF DESCRIPTION OF THE DRAWINGS

The present invention will be described in greater detail herein below with particular reference to a number of Drawings. In the accompanying Drawings.

DETAILED DESCRIPTION OF A PREFERRED EMBODIMENT

Figure 1:
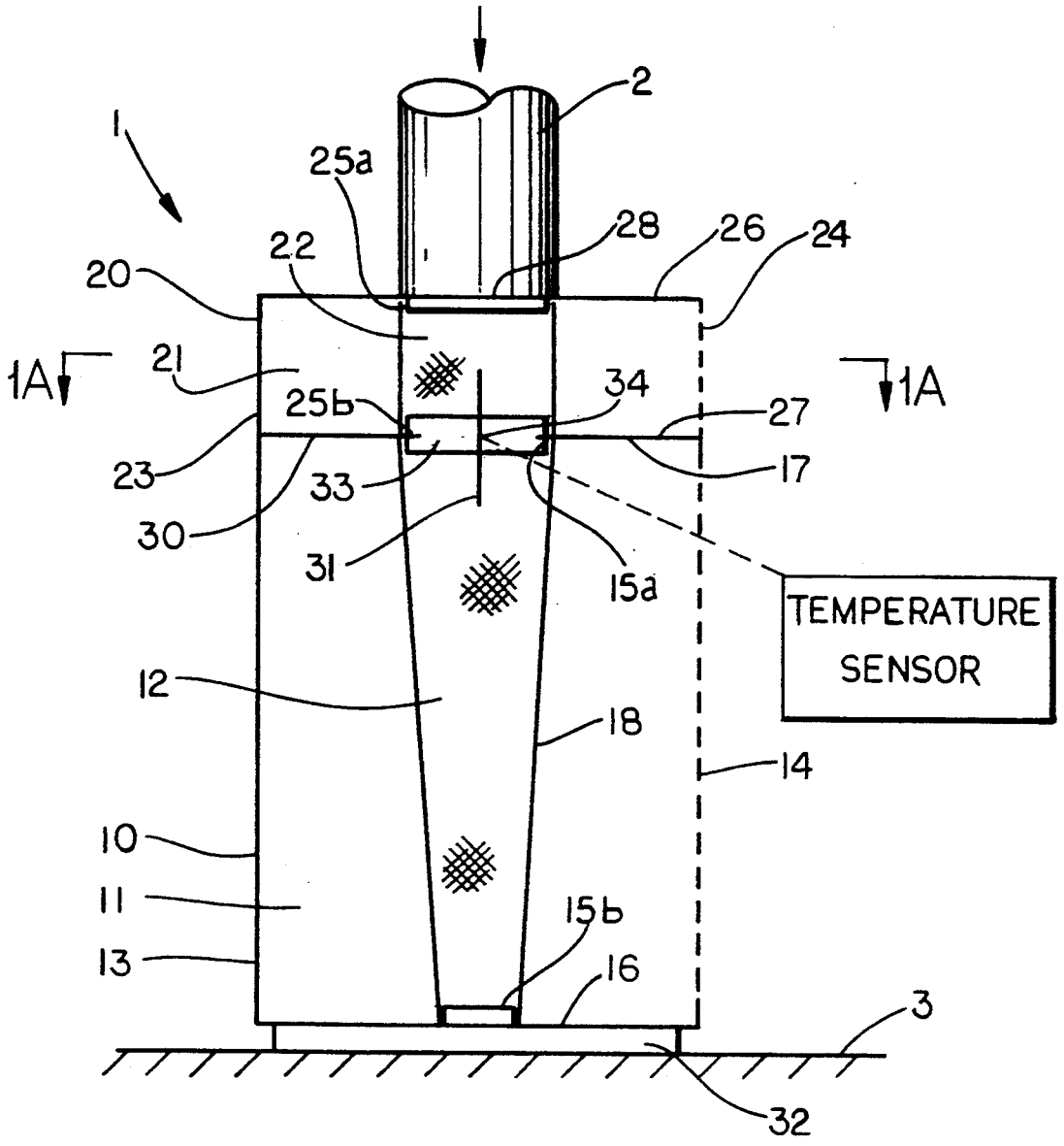
FIG. 1 is a vertical section through one preferred embodiment of an apparatus according to the present invention, with the apparatus set in the low impulse position.

The Figures show one embodiment of the invention in which an impulse device I is connected to an inlet duct 2 which, in its turn, is connected to a fan system supplying pure and cold, or alternatively warm air to one or more impulse devices. Each such impulse device includes a first impulse device 10 and a second impulse device 20. In the Figures, the impulse device is shown as provided with a skirting or plinth 32 for placing the impulse device 1 on, for example, a floor 3. In other embodiments, the impulse device is designed for suspended installation.

The first impulse device 10 is provided with a first equalization chamber 11 delimited by a defining wall 13, a base plate 16 and a partition 17, hereinafter referred to as first partition 17. The impulse device 10 is provided with one or more outlet devices 14, hereinafter generally referred to as first outlet devices 14. Each such outlet device consists, for example, of a perforated plate, a grid, a combination of a grid and plate, a grid which is coated with a filter material on the inside, a perforated plate which is coated with a filter material on the inside, etc. The design of the outlet device is determined by the intended character of the air current when the air departs from the impulse device 10.

In the Figures, the first impulse device 10 is disposed beneath the second impulse device 20. In the merging region between the two impulse devices, as disclosed in the embodiments shown in FIGS. 1 and 2, there is the first partition 17 which is provided with anchorages 15*a* for connection of a pressure distribution member 12, hereinafter generally referred to as first pressure distribution member 12, located in the first equalization chamber 11. The first pressure distribution member extends from the first partition 17 to the base plate 16. In the embodiment shown in FIGS. 1 and 2 the base plate is provided with anchorages 15*b* for connection of the first pressure distribution member 12 to the base plate 16 of the first impulse device. The pressure distribution member consists of a hollow body whose inner space 1 s supplied with air departing from the inner space through the defining wall 18 of the body. The defining wall is of a design adapted to this function and, as a rule, the major portion of the defining wall is designed to permit the passage of air. The air-permeable portion of the pressure distribution member consists, for example, of a perforated panel of plastic or of metal, the panel being as a rule a curved body, such as, a sock of air filter material, a sock of textile material, etc. In the embodiment shown in the Figures, the first pressure distribution member consists of a hollow truncated cone with its smallest circumference adjacent to the base plate 16 of the first equalization chamber.

An example of the second impulse device 20 is shown in the Figures. In the embodiment disclosed, the second impulse device 20 is also provided with an equalization chamber 21, hereinafter generally referred to as second equalization chamber 21, which is defined by a defining wall 23, a partition 27, hereinafter referred to as second partition 27, and a top plate 26. The second impulse device is provided with one or more outlet devices 24, hereinafter generally referred to as second outlet devices 24, of a construction corresponding to that disclosed for the outlet devices 14 of the first impulse device. The top plate is fitted with connections (not shown) for the inlet duct 2. In the shown embodiment of the second impulse device, the top plate 26 is further provided with an anchorage 25*a* for connection of a pressure distribution member 22, hereinafter generally referred to as second pressure distribution member 22, which is disposed in the second equalization chamber 21. The second pressure distribution member 22 extends from the top plate to the second partition 27, This is provided with anchorages 25*b* for connection of the second pressure distribution member 22 to the second partition 27. The second pressure distribution member has a function and construction comprising the fundamental function and construction as disclosed above or described below for the first pressure distribution member. In the embodiment shown in the Figure, the second pressure distribution member is of substantially cylindrical configuration. The inlet duct 2 is connected by the intermediary of an aperture 28 in the top plate 26 to the inner space of the second distribution member.

It should be noted, that in some embodiments, the second impulse device 20 does not include any specific pressure distribution member. The intended pressure distribution is obtained by an appropriate design of the inlet duct 2, of its connection to the second impulse device 20 and of the parts of the second impulse device through which the supply air i s passing.

In a preferred embodiment, the first partition 17 and the second partition 27 form a common partition 30 which defines the first equalization chamber 11 from the second equalization chamber 21. A passage 33 in the partition 30, or alternatively in the first and second partitions, forms a communication connection between the inner spaces of the pressure distribution member 12 disposed in the first equalization chamber 11 and the pressure distribution member 22 disposed in the second equalization chamber 21. A damper 31 is disposed to be moved to and from the positions illustrated in FIGS. 1 and 2, for example by being rotated about a shaft 34. In FIG. 1 (cf FIG. 1*a*) the damper assumes a substantially vertical orientation, in which event the communication between the inner spaces of the first pressure distribution member 12 and the second pressure distribution member 22 is open. The passage between the inlet duct 2 and inner spaces of both of the pressure distribution members 12 and 22, respectively, is, as a rule, thereby fully open and air from the inlet duct passes via the aperture 28 and each respective pressure distribution member to both the first and second equalization chambers.

Figure 2A:
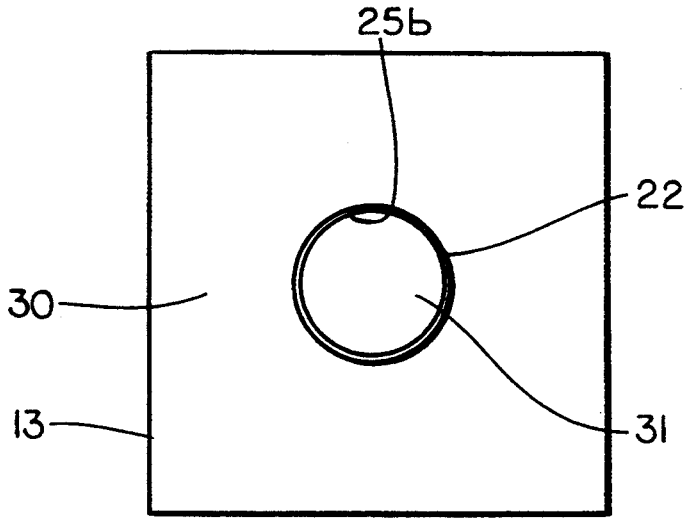
FIG. 2*a* is a cross section taken along the line 2*a*—2*a* in FIG. 2.
Figure 2:
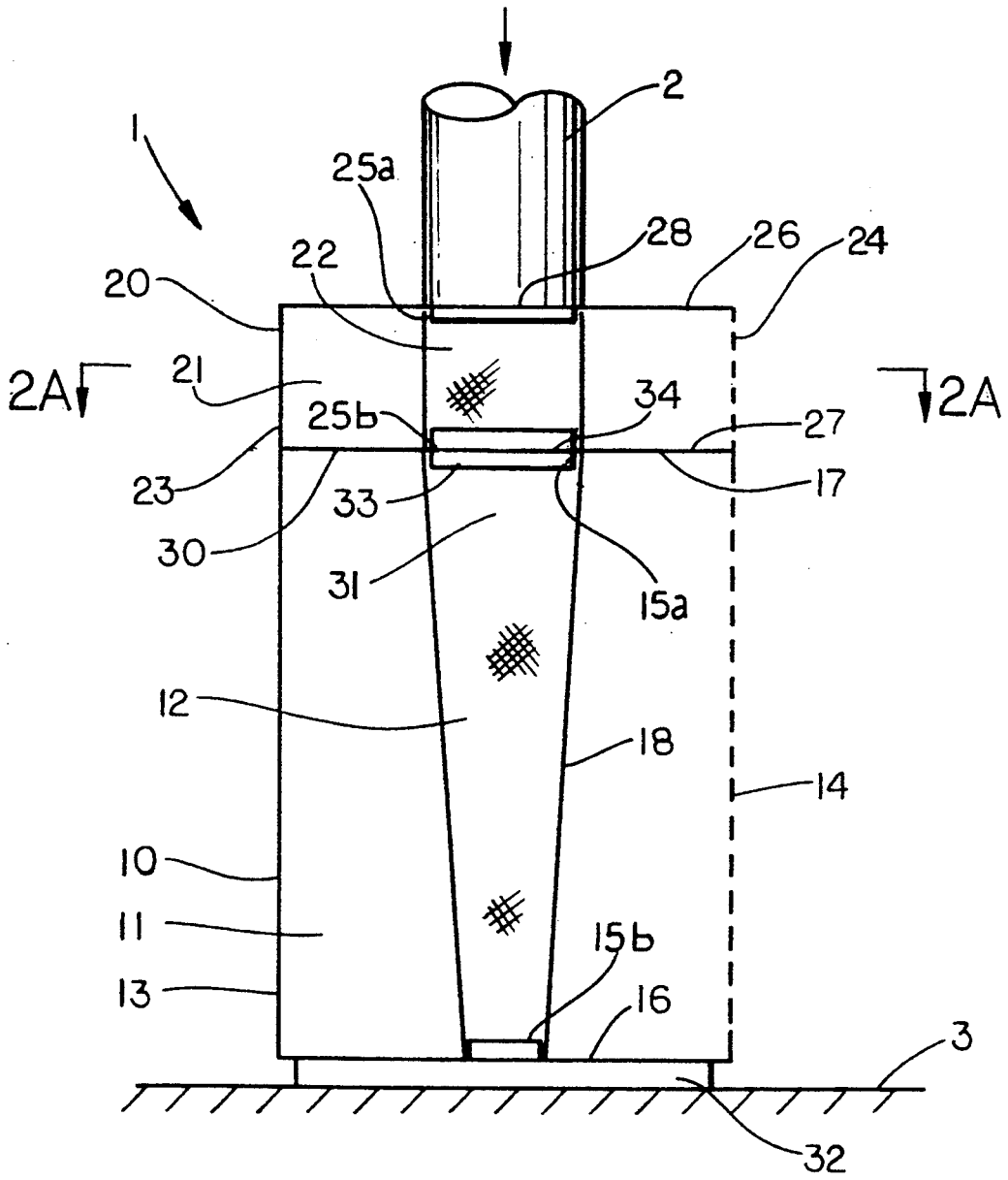
FIG. 2 is a vertical section corresponding to the section of FIG. 1, with the apparatus set in the high impulse position.

In the position illustrated in FIG. 2 (cf also FIG. 2*a*), the damper 31 has assumed a substantially horizontal position, in which event the passage between the two pressure distribution members is, as a rule, wholly closed. In practice it has in some embodiments shown to be appropriate to adapt the design for a leakage of air through the passage. On the other hand, the communication between the inlet duct 2 and the inner space of the pressure distribution member 22 of the second equalization chamber 21 is open. Hereby, air passes from the inlet duct 2 through the second distribution member 22 to the second equalization chamber 21, while the first equalization chamber is not supplied with air or supplied with air only to a limited extent, as a rule, to a very limited extent.

Figure 3:
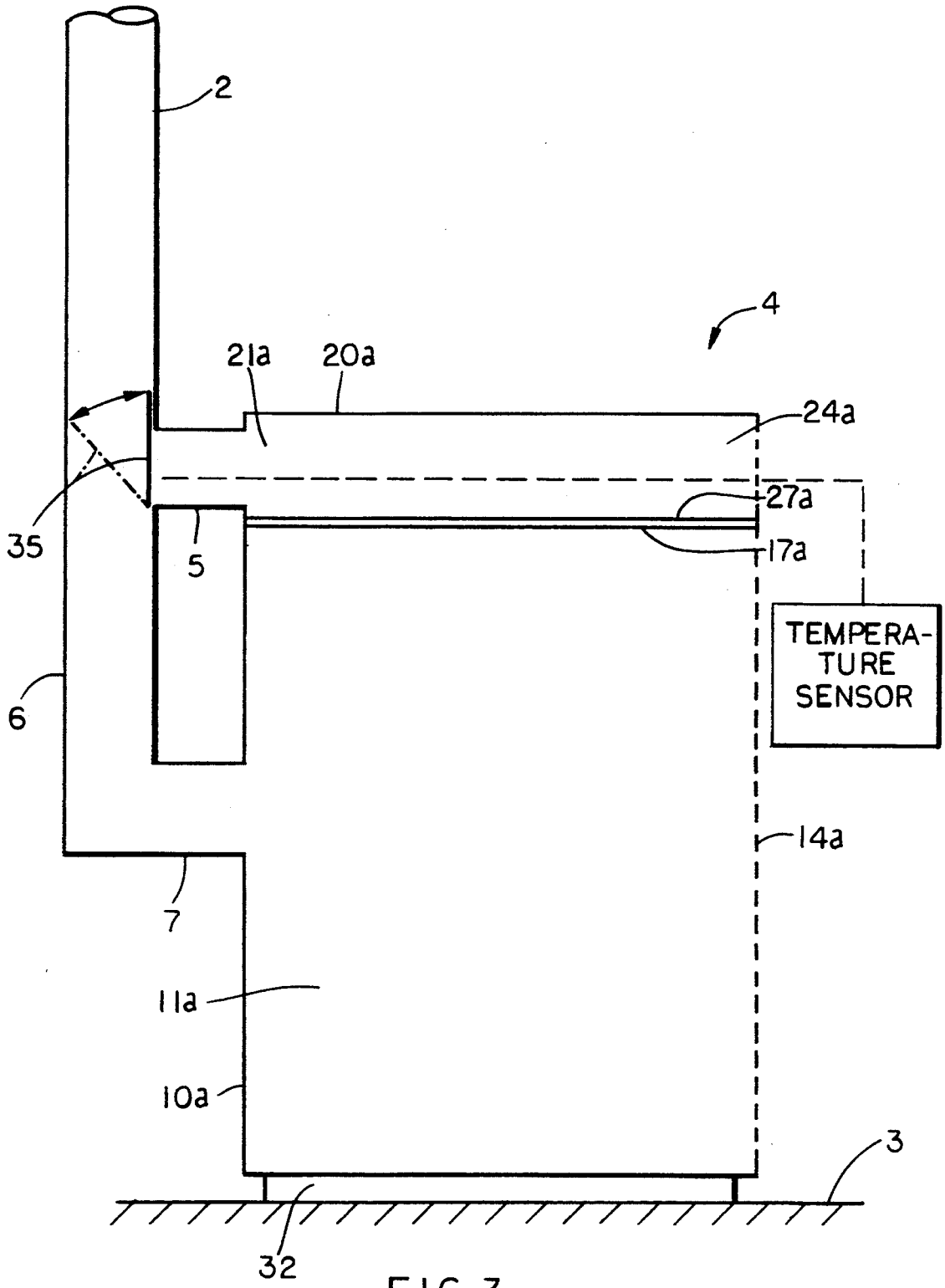
FIG. 3 is a vertical section illustrating the basic design of an apparatus according to the invention.

FIG. 3 shows an embodiment of a fundamental apparatus including an impulse device 4. According to the invention the apparatus comprises a lower impulse device 10*a* and an upper impulse device 20*a* corresponding to the previously described first impulse device 10 and second impulse device 20, respectively. The lower impulse device is dimensioned so as to operate as a low impulse device, and the upper impulse device so as to act as a high impulse device. The low impulse device 10*a* includes an equalization chamber 11*a*, an outlet device 14*a* and an upper defining wall 17*a*. The high impulse device 20*a* includes an equalization chamber 21*a*, an outlet device 24*a* and a lower defining wall 27*a*. Each one of the impulse devices is generally provided with pressure distribution members (not shown in the Figure) corresponding to those disclosed and specified in connection with FIGS. 1 and 2.

The inlet duct 2 is connected to a side channel 6. The high impulse device 20*a* and its equalization chamber 21*a* are connected thereto by the intermediary of a first supply channel 5. The low impulse device 10*a* and its equalization chamber lie are also connected to the side channel by means of a second supply channel 7. In the embodiment illustrated in FIG. 3, the supply channels 5, 7 are disposed on the rear side of the impulse device but, in certain embodiments, they may be located at other sites, for example at least some of the channels are disposed for connection to the upper or lower defining walls of the impulse device. A damper 35 is provided in the region of the connection of the side channels to the inlet duct 2 and is switchable between the position illustrated in the Figure (low impulse position) and the position shown by broken lines in the Figure (the high impulse position). In the low impulse position, the high impulse device is, as a rule, Shut off from air supply from the inlet duct 2, and in the high impulse position, the low impulse device is shut off from the air supply. In some embodiments the apparatus is designed for leakage of air as specified in connection with FIGS. 1 and 2.

FIG. 3 shows how the damper arrangement is located entirely outside the impulse devices. It is hereby possible, in certain practical applications, to place the low impulse device and the high impulse device separate from one another. In other practical applications, the low impulse device 10a and the high impulse device 20a are placed adjacent to one another or form a composite unit which constitutes the impulse device 4.

Figure 1A:
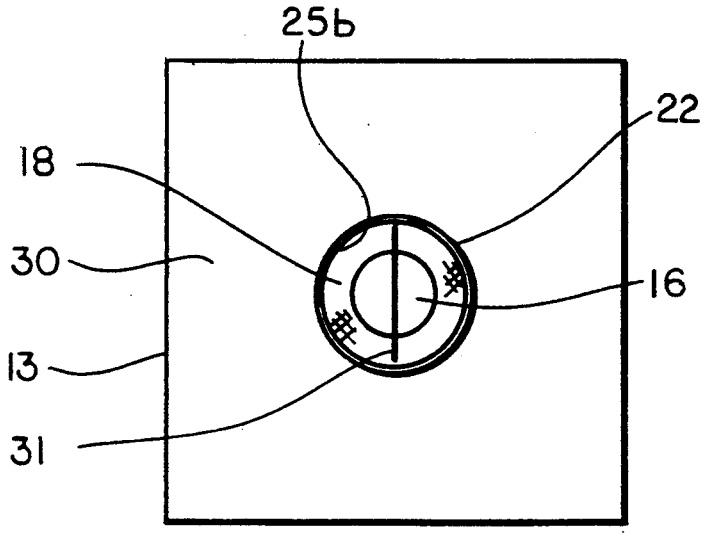
FIG. 1*a* is a cross section taken along the line 1*a*—1*a* in FIG. 1.

In the employment of the impulse device according to the embodiment illustrated in FIGS. 1 and 2 as a low impulse device, the damper 31 is set in the open position as illustrated in FIGS. 1 and 1a, respectively. Air passes to both the first and the second equalization chambers and, via both of the outlet devices 14, 24, to the premises to be ventilated. The total outlet area (the flow area) of the impulse device I consists of the total of the flow area of the first outlet device 14 and the second outlet device 24. As a rule, the relationship between the outlet areas of the two outlet devices is selected such that the outlet area of the first outlet device is substantially determinative of the speed at which the supply air leaves both of the outlet devices. The outlet area of the first outlet device 14 is substantially larger than the flow area of the inlet duct 2, for which reason the air, when it passes through the outlet apertures of the outlet devices, is at a speed which is reduced in relation to its speed in the inlet duct. The relationship between the total outlet area of the impulse device and the flow area in the inlet duct 2 is selected such that at a specific pressure the supply air is at a predetermined speed when it departs from both of the outlet devices 14 and 24, respectively. The pressure distribution member or the design of air flow passages ensures that the established requirements on uniform air flow will be satisfied without vortex formation. Hence, with the damper 31 in the open position, the impulse device 1 operates as a low impulse device.

On occasions when the impulse device is to operate as a high impulse device, the damper 31 is moved to the closed position illustrated in FIG. 2 and FIG. 2a, whereupon the air supplied from the inlet duct 2, as a rule, only passes to the second equalization chamber 21 and, via the outlet device 24 of the chamber, into the premises being ventilated. Given that the outlet area of the outlet device 24 of the second impulse device is substantially smaller than the outlet area of the first outlet device, the contemplated effect will be achieved that that air which departs from the outlet device of the second impulse device is at substantially higher speed than that air which departed from both of the outlet devices 14, 24 of the impulse device at the previous setting of the damper 31.

The relationship between the outlet area of the second impulse device 20 and the flow area in the inlet duct 2 is selected such that the supply air departs from the second outlet device 24 at a predetermined speed which is selected so as to achieve the desired throw for the impulse device. The pressure distribution member and/or the design of the air flow passages of the impulse device ensure that established requirements of uniform air flow without vortex formation will be satisfied. With the damper 31 in the closed position, the impulse device 1 thus operates as a high impulse device. The impulse device is switched to work as a high impulse device when, for example, the temperature of the supply air is at a level substantially corresponding to the temperature of the indoor air, or is at a temperature slightly less than or exceeding the temperature of the indoor air.

The long throw achieved in accordance with the preceding paragraph implies that the supply air deflects towards the ceiling of the room only after a relatively long distance. This results in impure or stale air which is located within the range of the throw of the impulse device being brought, by induction, to accompany the supply air and be displaced towards the ceiling of the room together with the warm supply air. There will hereby be achieved a purification of the air in the room and the reduction of the level of impurities, as a rule without employing the technique of diluting the air of the premises, as is the, case in mixing ventilation. As a result of the present invention, it is hence possible to achieve an effect similar to that in displacing ventilation, which implies that the supply air conveys impurities towards the ceiling of the room where suction extraction of impure or stale air takes place. A concentration of impurities will thereby occur adjacent to the ceiling of the room, while, in the area most proximal the floor of the room, the level of pollution of the air is considerably lower.

It will be obvious to a person skilled in the art that the combination of the high impulse device and the low impulse device may be variable according to the present invention. Thus, as shown in FIG. 3, in certain practical applications, the devices for switching the combination to operate as low impulse device or as high impulse device are disposed wholly outside the first or second impulse device. Similarly, the design of the switching devices may be varied. Otherwise, the combination, shown in FIG. 3, of the first impulse device 10a and the second impulse device 20a is disposed in correspondence with that described above or to be described below for the impulse device 1 according to FIGS. 1–2, for which reason the combination according to FIG. 3 has a function corresponding to that described for the impulse device 1 according to FIGS. 1–2.

In certain embodiments, temperature sensors are provided which sense the temperature of the indoor air and of the supply air, as well as means for temperature-dependent activation or deactivation of the separate high impulse device 20a, or switching of the impulse device 1 to high or low impulse device when the necessary conditions prevail. In one preferred embodiment, the devices are designed to be adjustable for adaptation, in compliance with the current needs of the ventilated premises, of that temperature difference (if any) at which switching or activation and deactivation, respectively, are to take place.

In one preferred embodiment, the outlet apertures of the outlet device 24 of the second impulse device (the high impulse device) are located at a height above floor level of at most approx 2.5 m, preferably at most approx 2.2 m and as a rule at most approx 2.0 m. This implies that the jet of supply air departs from the impulse device at a height which, as maximum, corresponds to approx $\frac{1}{3}$, preferably at most approx $\frac{1}{4}$ of the distance between floor and ceiling.

Most proximal the impulse device, the jet of supply air is directed substantially horizontally, this term also encompassing directions which deviate from the horizontal plane upwardly or downwardly by at most approx 30°, as a rule at most approx 15°. On leaving the high impulse device, the supply air forms a relatively thin jet in the vertical direction, with a vertical extent of at most approx 0.8 m, preferably at most approx 0.6 m and generally at most approx 0.4 m. That Jet formed by the supply air and preferably consisting of warm air has a length of at least approx 3 m, preferably at least approx 5 m and generally at least approx 8 m. Its vertical extent and flow rate are adapted to one another so that the supply air in the pertinent practical application achieves the predetermined throw.

In certain practical applications of the present invention, the outlet apertures of the second impulse device are optionally disposed adjacent to the floor. This latter alternative is most readily achieved by, for example, turning one of the impulse devices shown in the Figures upside down. The connection to the inlet duct for supply air is, of course, adapted to the modified orientation of the impulse device. In practical applications in which the inlet duct connects from the floor, no major alterations are required in, for example, the embodiment according to FIG. 1.

It will also be obvious to a person skilled in the art that the level of the outlet apertures of the outlet devices is adaptable to meet the particular requirements placed by each individual practical application. It will also be obvious that the impulse devices as such are suitable to be disposed for connection to the inlet duct both in the upper and in the lower region. Naturally, lateral connection to the inlet duct may al so be realized.

The present invention also encompasses embodiments in which the switching device 35 may be set at intermediate positions, which entail that, as a rule, only a limited air flow is supplied to one of the impulse devices, while the other impulse device receives substantially full supply flow of air. In certain practical applications, these embodiments are employed, for instance, to allow both of the impulse devices to operate as low impulse devices, or to allow, in heating contexts, the low impulse device to supply the premises with a generally slight flow of warm air.

It will also be obvious that the present invention is not restricted to a particular horizontal cross section of the impulse device. Hence, in certain practical applications, the cross section is circular, in others rectangular, and in yet others formed as combinations of straight and curved sides. In other words, the cross sectional configuration is adapted to meet the contemplated siting in the premises and in accordance with the desired distribution of supply air and of impulse devices in the premises.

In the foregoing, the qualifications upper and lower (and corresponding expressions) have occasionally been employed. It is obvious that these qualifications merely relate to the orientation of the impulse devices in the Figures and that such qualifications are, as a rule, merely employed to facilitate an understanding of the disclosure of the present invention.

The above detailed description has referred to but a limited number of embodiments of the present invention, but the skilled reader of this specification will readily perceive that the present invention encompasses a large number of embodiments without departing from the scope of the appended claims.

I claim:

1. A method for heating, cooling and ventilating an enclosed space having a suction outlet for air removal in a region of the ceiling of the space, said method comprising:

supplying air into said space in a substantially horizontal band, by a first impulse device at a relatively low speed with a substantially uniform distribution, said band extending from a floor of said space to a height of about 2 to 2.5 meters thereabove during cooling and ventilation phases of said space, and supplying air into said space through a second impulse device, located above said first impulse device, in the form of an air jet which is relatively narrow compared to said band of air produced by said first impulse device, said air jet flowing substantially horizontally into said space at a relatively high flow rate to form a horizontal air layer extending a substantial distance beyond said second impulse device to sweep polluted air from said space.

2. A method as claimed in claim 1, comprising effecting the supplying of air to the space by said second impulse device at a temperature above the temperature of the air in said space.

3. A method as claimed in claim 2, comprising effecting the supplying of air to the space by said second impulse device in said air jet having a height between about 0.4 and 0.8 meters at a distance from the floor of between about $\frac{1}{3}$ to $\frac{1}{4}$ of the distance from the floor to the ceiling of the space.

4. A method as claimed in claim 2, wherein said air jet propels the air from said second impulse device over a distance of between about 3 and 8 meters from said second impulse device.

5. A method as claimed in claim 4, comprising maintaining said jet in a stream deviating from the horizontal by an angle not more than between and 15° and 30°.

6. A method as claimed in claim 2, comprising sensing the temperature of the air in the enclosed space and the air being supplied thereto, comparing the temperatures and controlling the flow of air from said first and second impulse devices based in said comparing.

7. A method as claimed in claim 6, comprising deviating the flow of air to said first and second impulse devices at relative rates of air flow based on said comparing.

8. Apparatus for heating, cooling and ventilating an enclosed space having a suction outlet for air removal in a region of the ceiling of the space, said apparatus comprising:

first impulse means for supplying air into said space, in a substantially horizontal band, at a relatively low speed with a substantially uniform distribution, said band extending from a floor of said space to a height of about 2 to 2.5 meters thereabove during cooling and ventilating phases of said space, and second impulse means located above said first impulse means for supplying air into said space in the form of an air jet which is relatively narrow compared to said band of air produced by said first impulse means, said air jet flowing substantially horizontally into said space at a relatively high flow rate to form a horizontal air layer extending a substantial distance beyond said second impulse means to sweep polluted air from said space.

9. Apparatus as claimed in claim 8, comprising switching means for switching air from an air supply selectively to said first impulse means.

10. Apparatus as claimed in claim 9, wherein said switching means has a position to divert all of the supply air to said second impulse means.

11. Apparatus as claimed in claim 9, wherein said first and second impulse means are combined into a common assembly.

12. Apparatus as claimed in claim 11, wherein said common assembly comprises a housing in which said first impulse means forms a lower chamber and said second impulse means forms an upper chamber, and partition means in said housing separating said chambers from one another.

13. Apparatus as claimed in claim 9, comprising sensing means for sensing temperature of air in the enclosed space and air being supplied to said first and second impulse means, said sensing means being operatively coupled to said switching means to control flow of air to said first and second impulse means based on the sensed temperature of the air.

14. Apparatus as claimed in claim 13, wherein said switching means is operative to divert all the air flow to said second impulse means in response to a signal from said sensing means.

15. Apparatus as claimed in claim 13, comprising an air supply passage between said first and second impulse means, said switching means being disposed relative to said passage to close said passage when all the supply air is diverted to said second impulse means.

16. Apparatus as claimed in claim 15, wherein said first impulse means is connected to supply of air thereto via said air passage and said second impulse means.

17. Apparatus as claimed in claim 12, comprising an air passage including a porous duct extending in said housing through said first and second impulse means, said porous duct being cylindrical in said upper chamber and tapered in said lower chamber, said housing having an outlet means for said first and second impulse means in said upper chamber and said lower chamber.

18. Apparatus as claimed in claim 17, wherein said switching means is disposed in said porous duct.

* * * * *